US006170229B1

(12) United States Patent
Kim

(10) Patent No.: US 6,170,229 B1
(45) Date of Patent: Jan. 9, 2001

(54) TABLET CASSETTE FOR AUTOMATIC TABLET SORTING AND COUNTING MACHINE

(76) Inventor: Jin Soo Kim, 224-37 Naedang-Dong, Suh-gu, Taegu (KR)

( * ) Notice: Under 35 U.S.C. 154(b), the term of this patent shall be extended for 0 days.

(21) Appl. No.: 09/353,199

(22) Filed: Jul. 14, 1999

(30) Foreign Application Priority Data

Jul. 18, 1998 (KR) ..... 98-13261 U

(51) Int. Cl.[7] ..... B65B 38/06; B65H 3/00
(52) U.S. Cl. ..... 53/155; 53/238; 221/265
(58) Field of Search ..... 53/168, 154, 155, 53/237, 238, 445, 474; 221/265

(56) References Cited

U.S. PATENT DOCUMENTS

| | | | | |
|---|---|---|---|---|
| 4,903,861 | * | 2/1990 | Yuyama | 221/265 |
| 5,097,652 | * | 3/1992 | Inamura et al. | 53/168 X |
| 5,219,095 | * | 6/1993 | Shimizu et al. | 221/265 X |
| 5,667,096 | * | 9/1997 | Wu | 221/265 X |
| 5,671,592 | * | 9/1997 | Yuyama et al. | 53/493 |
| 5,709,063 | * | 1/1998 | Yuyama et al. | 53/154 |
| 5,765,606 | * | 6/1998 | Takemasa et al. | 53/168 X |
| 5,803,309 | * | 9/1998 | Yuyama et al. | 221/82 |
| 5,852,911 | * | 12/1998 | Yuyama et al. | 53/168 |
| 5,865,342 | * | 2/1999 | Ito et al. | 221/265 |
| 5,927,546 | * | 7/1999 | Yuyama et al. | 221/265 |

* cited by examiner

*Primary Examiner*—Peter Vo
*Assistant Examiner*—John Paradiso
(74) *Attorney, Agent, or Firm*—John K. Park; Park & Sutton LLP

(57) ABSTRACT

A tablet cassette for an automatic tablet dispensing system is disclosed. The tablet cassette includes a cylindrical rotor received into a medicine case of the tablet cassette and engaged to a male gear fixed to a motor shaft located within a driving unit. The rotor has a waved guide formed along an conically tapered upper surface thereof and a protrusion formed on a central surface portion thereof so as to smoothly agitate the received tablets and preventing from tangling together with said waved guide. The cylindrical rotor has a plurality of guide teeth formed along an outer periphery of the rotor body and a plurality of insert openings regularly provided between said guide teeth to respectively receive one tablet therein. At least one auxiliary case has an upper and a lower engagement steps formed along the periphery thereof. The upper engagement step has thrust bumps along an upper periphery thereof to facilitate engagement onto an upper portion of the medicine case having a corresponding engagement step formed along an upper periphery thereof, and the lower engagement step of the said auxiliary case has thrust grooves formed in correspondence to the thrust bumps of the medicine case. A cover is provided onto an upper portion of the medicine case or said auxiliary case. The cover includes a porous compartment formed underneath a lower surface thereof, wherein preservatives or demoisturants can be placed.

5 Claims, 5 Drawing Sheets

TABLET CASSETTE FOR AUTOMATIC TABLET SORTING AND COUNTING MACHINE

BACKGROUND OF THE INVENTION

1. Field of Invention

The present utility model relates to a tablet cassette for an automatic tablet sorting and counting machine commonly referred to as "automatic tablet dispensers". More specifically, the present invention is an improved tablet cassette which is capable of facilitating a tablet packaging operation in a packaging unit of an automatic tablet dispenser by supplying to an output port of a drum the exact desired quantity of tablet.

2. Description of the Prior Art

Automatic tablet dispensers are generally employed in hospitals, pharmacies, and drugstores to automate the output and assembly of corresponding tablets when the prescription is input into a computer. They serve to dispense the per-dosage assembled tablets in individual single serving packages.

A conventional automatic tablet dispenser includes the following: a main computer for calculating an appropriate prescription on the basis of the type of medicine, intake method, daily intake frequency and intake duration depending upon each patient; a tablet dropping unit having a plurality of tablet cassettes and a drum for storing therein and releasing therefrom the tablets in correspondence to the prescription set up in the computer; and a packaging unit disposed below the tablet dropping unit which serves to package a quantity of tablets and release the same to an exterior of the automatic tablet dispenser.

A tablet cassette serves to discharge to-be-packaged tablets on the basis of information input in the main computer. In general, the tablet cassette includes a tablet case having a driving unit and housing a slanted rotor, which rotates in accordance with the driving unit. A plurality of space between a plurality of guide teeth is formed along the outer periphery of the rotor, wherein the tablets are dropped into the space one by one and released by the rotor through an outlet into the tablet dropping unit with the rotation of the rotor.

A predetermined space sufficient to house the tablets therein is provided from the bottom surface of the tablet case. However, the room for the rotor and tablet case relatively becomes narrow due to the assembly clearance which occurs during the assembly of the driving unit, medicine case and rotor. The tablets should be smoothly supplied into the tablet dropping unit with the rotation of the rotor, but the conventional system has a disadvantage in that the space between the rotor and the medicine case cannot be constantly maintained during the assembly or for other reasons. This disadvantage sometimes prevents a timely release of the tablets resulting from jamming or tangling when the tablets in the medicine case are supplied toward the rotor.

Also, conventional tablet cassettes are provided in fixed measurement regardless of tablet size. Thus a different quantity of tablets is received in each cassette depending upon tablet sorts and size and accordingly requiring frequent tablet supplementation.

Furthermore, when a large quantity of small tablets are contained in a tablet cassette, the release duration becomes relatively larger, which can cause the tablets contained therein to be subject to moisture and deformation.

SUMMARY OF THE INVENTION

The present utility model is contrived to overcome the conventional disadvantages. Therefore, it is an object of the present invention to provide a tablet cassette according to the utility model, capable of easily adjusting the size of a medicine case, preventing the internally contained medicine from deforming, and facilitating the tablet release by improving function of a rotor related thereto.

It is another object of the present invention to provide a tablet cassette which smoothly and timely releases tablets into a tablet dropping unit.

It is yet another object of the present invention to provide a tablet cassette which is inexpensive to manufacture.

To achieve the above-described objects, there is provided a tablet cassette for an automatic tablet sorting and counting machine according to the present utility model, which includes: a cylindrical rotor received into a medicine case of the tablet cassette and engaged to a male gear fixed to a motor shaft located within a driving unit. The rotor has a waved guide formed along a conically tapered upper surface thereof and a protrusion formed on a central surface portion thereof so as to smoothly agitate the received tablets and prevent them from tangling together with the waved guide. The cylindrical rotor has a plurality of guide teeth formed along an outer periphery of the rotor and a plurality of insert openings regularly provided between the guide teeth to respectively receive one tablet.

An advantage of the present invention is to smoothly load the tablets temporarily maintained in the medicine case downwardly into each of the insert openings by providing the vertically raised protrusion. Another advantage is to prevent tablet tangling and weight pressure of the randomly stacked tablets in the medicine case.

BRIEF DESCIPTION OF THE DRAWINGS

Figure 3:
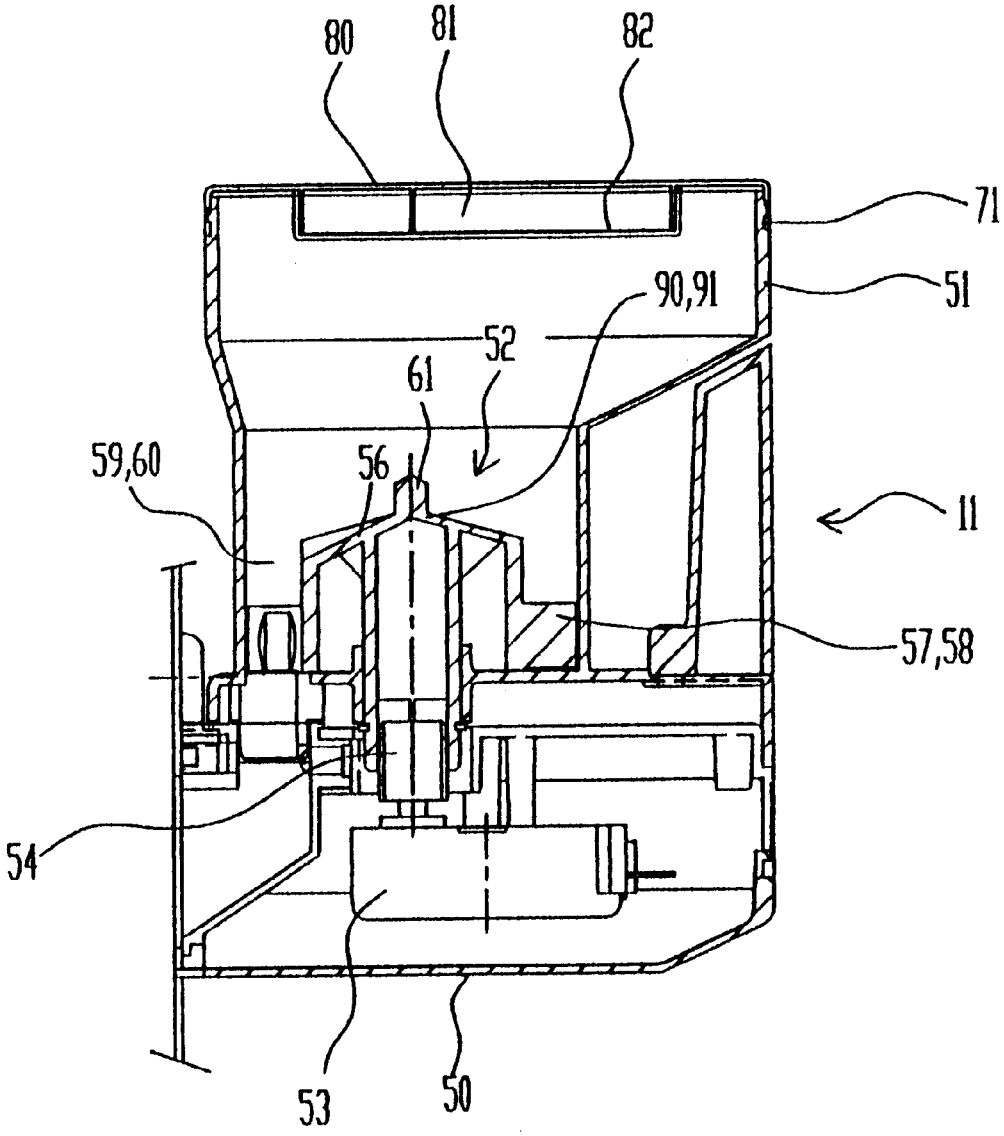
Figure 4:
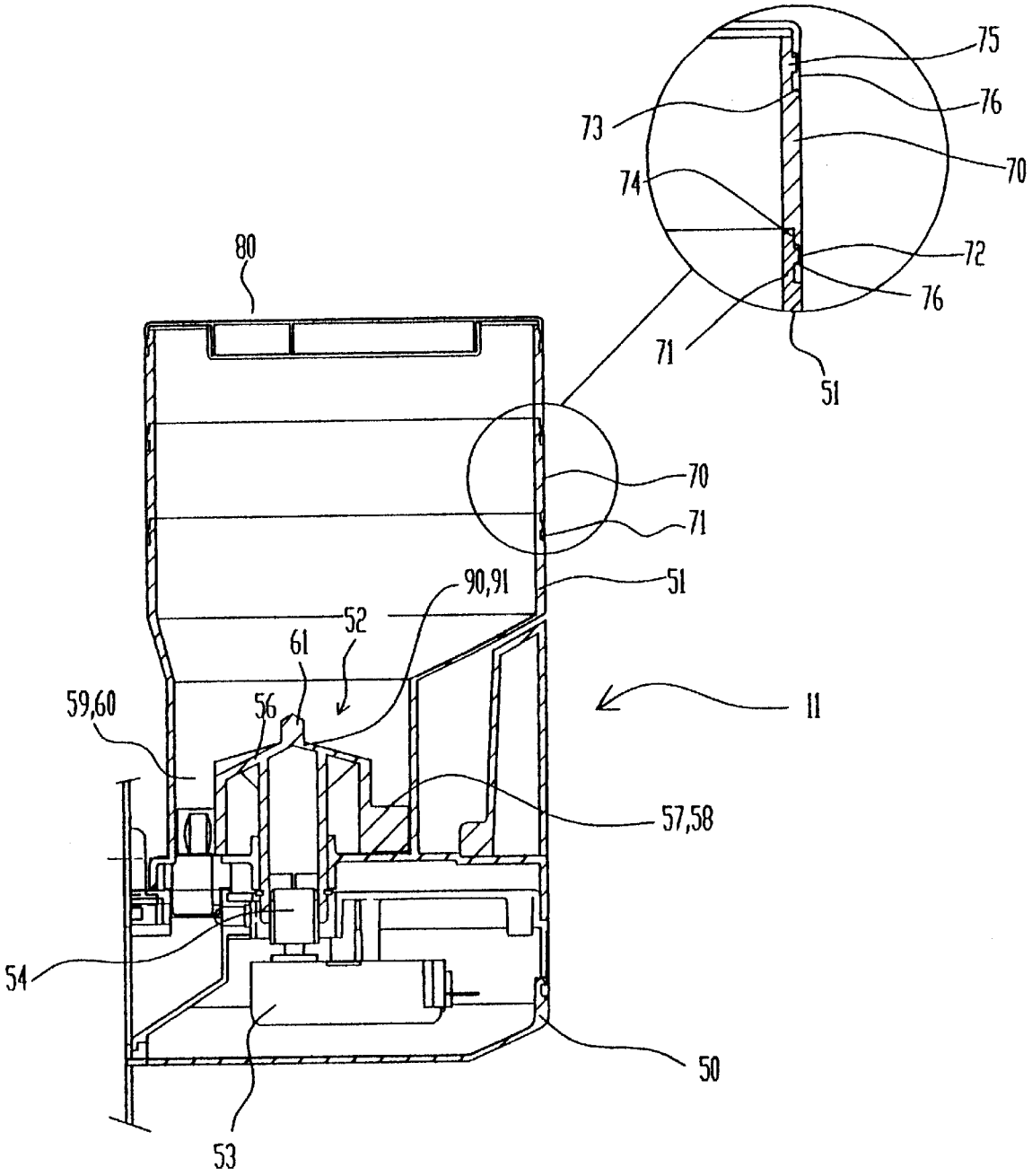

FIG. 3 is a cross-sectional view illustrating the assembly of a tablet cassette for an automatic tablet dispenser according to the present utility model; and FIG. 4 is a is a cross-sectional view illustrating a tablet cassette for an automatic tablet dispenser according to the present utility model, wherein the capacity of the medicine case is increased by connecting an auxiliary case to the tablet cassette.

DETAILED DESCRIPTION OF THE PREFERRED EMBODIMENTS

With reference to the accompanying drawings, the present utility model will now be described.

Figure 1:
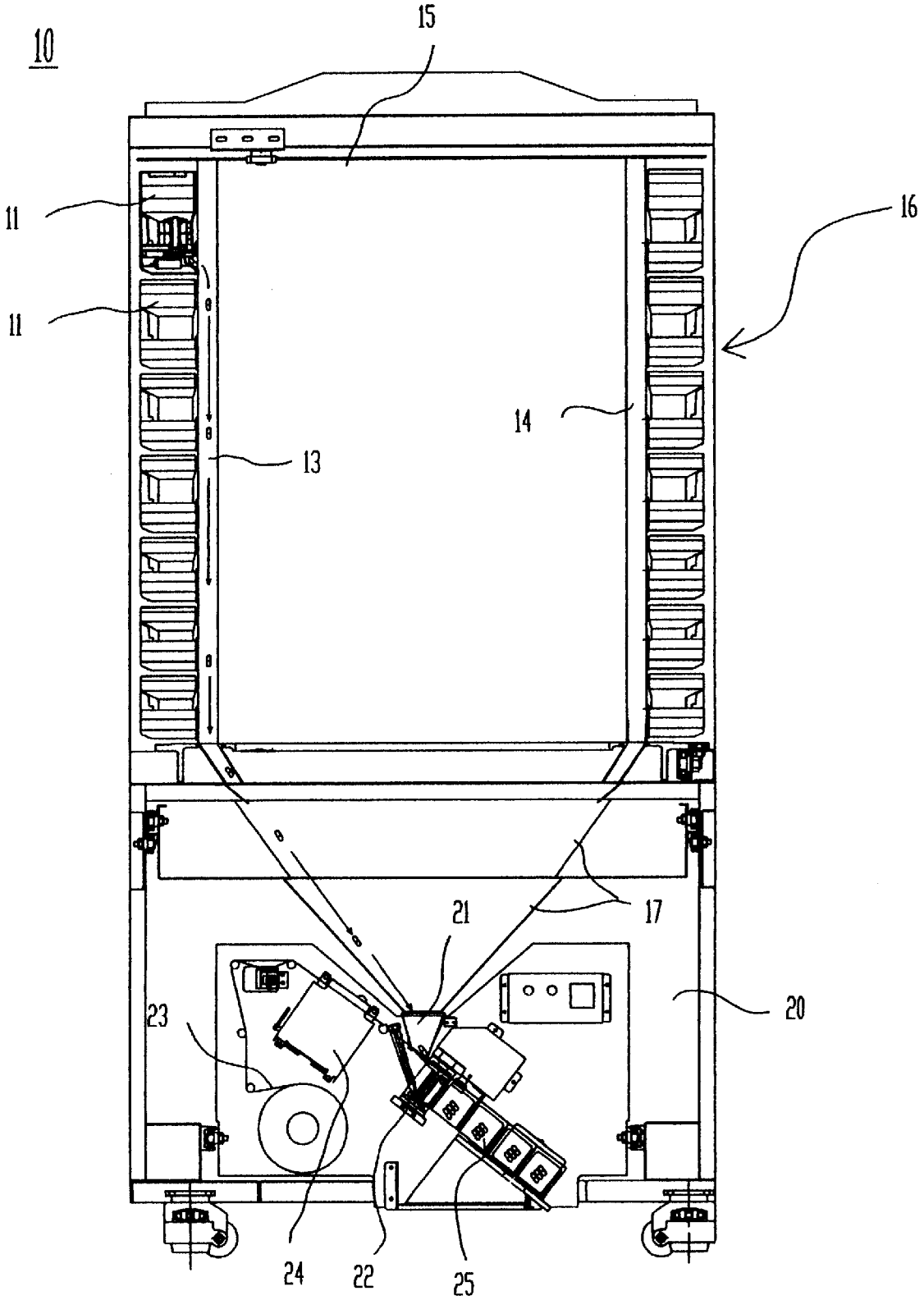
FIG. 1 is a schematic view illustrating a conventional automatic tablet dispenser with the front panel removed to show the inner components.

As shown in FIG. 1, an automatic tablet dispenser 10 has a tablet dropping unit 16 including a cylindrical drum 15 having release holes 13, 14 engaged thereto so as to communicate a plurality of tablet cassettes 11 which respectively store therein tablets and release a measured quantity therefrom through the outer periphery of the release holes 13, 14, so that the tablets released from the tablet cassettes 11 are dropped through the holes 13,14.

Below the tablet dropping unit 16 there is provided a guide hopper 17 for safely guiding the tablets being released through the release holes 13, 14 so that the tablets may not be dispersed.

A packaging unit 20 is disposed below the guide hopper 17 to package and discharge the released tablets outside the automatic tablet dispenser 10.

The packaging unit 20 includes a discharge hopper 21 for gathering the tablets dropped from the tablet dropping unit 16, a heater assembly 22 for packaging the tablets released through the discharge hopper 21, a printer 24 for printing respective information on the packaging paper 23, and a discharge conveyer 25 for externally releasing respective tablet-packaged bags.

The automatic tablet dispenser 10 is controlled by a main computer (not shown) informed of an appropriate prescription for a target patient which includes proper medicine, intake method, daily intake frequency, and intake duration.

In such an automatic tablet dispenser 10, each tablet cassette 11 releases the to-be-packaged tablets based on the information input into the main computer.

Figure 2:
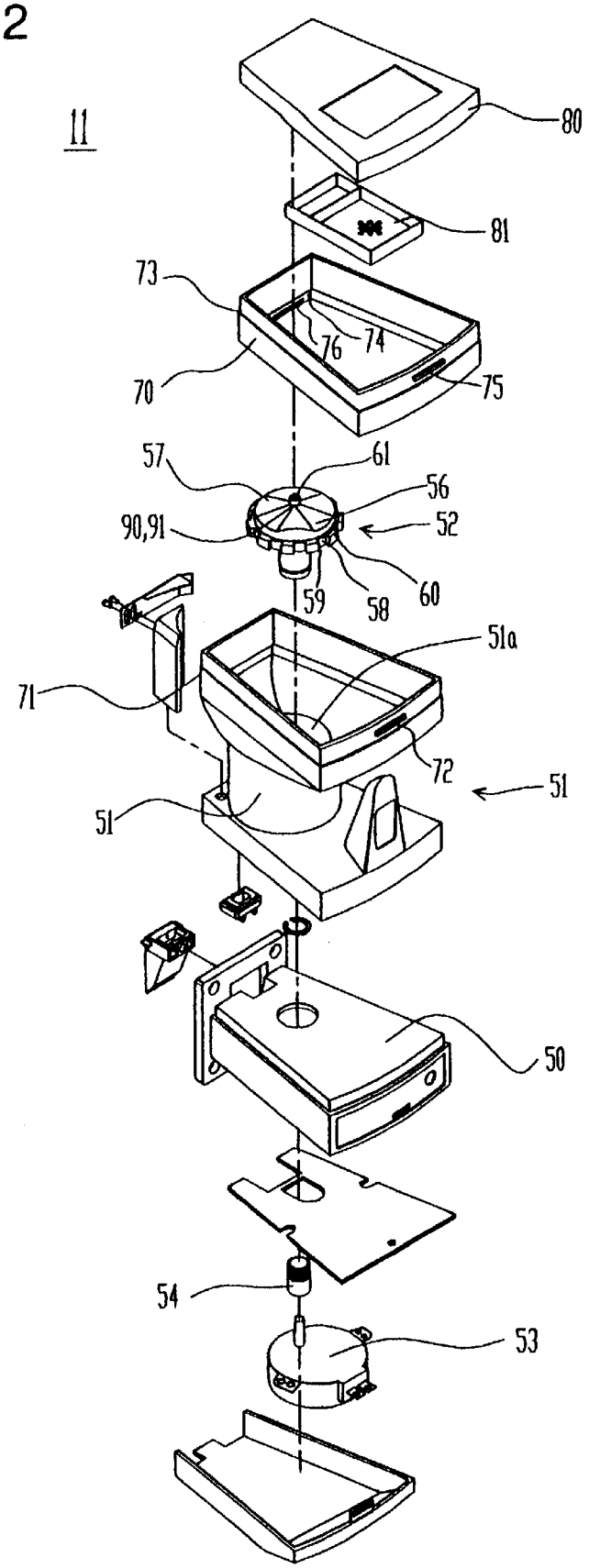
FIG. 2 is an exploded perspective view illustrating a tablet cassette for an automatic tablet dispenser according to the present utility model.
Figure 2A:
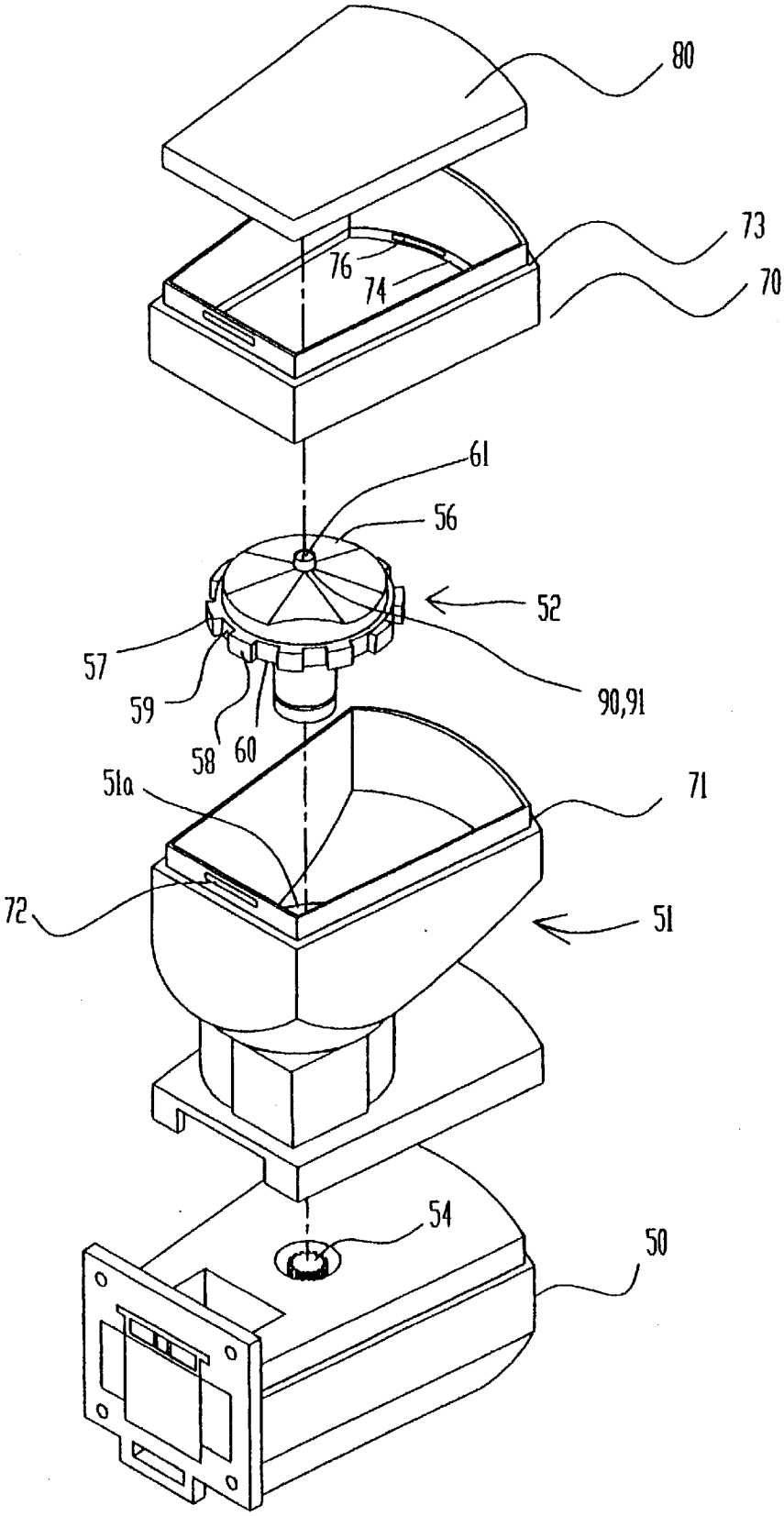
FIG. 2A is an exploded perspective view detailing the cylindrical rotor and the medicine case in FIG. 2.

As further shown in FIGS. 2 through 4, the tablet cassettes 11 are respectively formed of a driving unit 50, a medicine case 51 and a rotor 52.

The present utility model improves the respective function of the medicine case 51 and the rotor 52 of the tablet cassette 11, thereby facilitating the operation of tablet release and preventing deformation of the medicine.

Specifically, the rotor 52 received in the medicine case 51 is vertically engaged onto a male gear 54 fixed into a shaft of a motor 53 which is located within the driving unit 50 so as to prevent a space from generating between the bottom surfaces of the rotor 52 and the medicine case 51, thereby improving tablet releasing capability. That is, the medicine case 51 has a cylindrical opening 51*a* formed through a lower portion thereof and the rotor 52 is rotatably introduced through the cylindrical opening 51*a* to temporarily maintain the tablets within the medicine case 51.

A waved guide 56 is formed on upper surface 56*a* of the cylindrical rotor 52 and has a vertex 91 so as to smoothly agitate the received tablets and prevent them from tangling. The waved guide 56 is conically tapered toward a central portion 90 of the upper surface 56*a* of the rotor 52 and has a plurality of sectors 56*b*, 56*c* alternately flattened and raised. A plurality of guide teeth 57, 58 are formed with the same interval spaced from each other. A plurality of tablet insert openings 59, 60 are correspondingly formed between the guide teeth 57, 58 in oneness to respectively receive one tablet therein. A vertically raised protrusion 61 is upwardly formed on an upper central surface portion 90 of the cylindrical rotor 52 so as to facilitate distribution of the tablets into the openings 59, 60. The vertically raised protrusion 61 allows the tablets to be evenly loaded into each insert opening 59, 60 when the rotor 52 is rotated by the male gear 54. The protrusion 61 may be formed in cylinder.

As illustrated in FIG. 4, more than one auxiliary case wall 70 may be vertically stacked onto the upper portion of the medicine case 51 so as to simultaneously accommodate therein a larger quantity of tablets in correspondence to size, sorts and usage frequency of the tablets.

For that purpose, engagement steps 73, 74 are formed along the upper periphery of the medicine case 51 and thrust bumps 72 are formed on the front and rear surface of the combination step 71.

The engagement steps 73, 74 are formed on the upper and lower end of the combined auxiliary case 70. The lower engagement step 73 is formed inside, and the upper engagement step 74 is formed outside, thereby realizing a reciprocal engagement.

Thrust bumps 75 and thrust grooves 76 are formed in oneness at the engagement steps 73, 74 of the auxiliary case 70 so as to maintain the reciprocal engagement state. The thrust bumps 75 are formed at the upper engagement step 74 and the thrust grooves 76 are formed at the lower engagement step 73.

A cover 80 is engaged to the upper portion of the medicine case 51. A receivable compartment 81 is formed underneath the cover 80 and a porous covering 82 is provided to cover the compartment 81. The compartment 81 may contain preservatives and demoisturants such as SILICA GEL® so as to facilitate dehydration and prevent deformation of the medicine.

The tablet cassettes 11 according to the present utility model are fixed to the drum 15 as applied when using a common tablet cassette, and the packaging operation is completed in the lower packaging unit 20. As the operation of the automatic tablet dispenser is well known in the conventional art, a detailed explanation will be omitted accordingly. Instead, the advantages of the tablet cassette 11 will now be intensively described.

The tablet cassette 11 according to the present utility model prevents tablets from being tangled since no space is generated between the cylindrical rotor 52 and the bottom surface of the medicine case 51, wherein the tablet cassette 11 has the rotor 52 inserted therein and rotated by the male gear 54 engaged to the motor 53 in the driving unit 50 so as to release one tablet.

Particularly, the waved guide 56 and protrusion 61 formed along the upper surface 56*a* of the rotor 52 enables the medicine case 51 to receive the tablets and evenly distribute the received tablets into the insert openings 59, 60. Also, even with an intensive supply of the tablets in the casette 11, tablets can be dropped into the tablet insert openings 59, 60 between the guide teeth 57, 58 formed along the outer periphery of the rotor 52 without tangling.

Also, the medicine case 51 engages the auxiliary case 70 in a multi-step manner to an upper end of the medicine case 51 in correspondence to size, sorts and usage frequency of the target tablets so as to increase tablet capacity.

Further, protection agents such as preservatives or demoisturants are received into the receivable recess 81 formed in oneness at the cover 80 which is engaged to the upper end of the medicine case 51 or the auxiliary case 70, thereby preventing deformation of the tablets received in the medicine case 51. One of the advantages of the present invention is to smoothly load the tablets temporarily maintained in the medicine case 51 downwardly into each of the insert openings 59, 60 by providing the vertically raised protrusion 61.

As discussed above, the system according to the present utility model improves efficiency of tablet dispensing operation by smoothly releasing the tablets contained therein by upgrading the function of the rotor and preventing the internally stored tablets from being deformed.

What is claimed is:

1. An improved automatic tablet dispenser comprising a tablet dropping unit having a drum communicating with a plurality of release holes which open to a plurality of tablet cassettes storing therein and releasing therefrom a measured quantity of tablets, wherein each of said tablet cassettes comprising:

a) a medicine case having a cylindrical opening through a lower portion thereof;

b) a cylindrical rotor having an upper surface and a vertically formed outer periphery, wherein the upper surface has a central portion, wherein a plurality of guide teeth are formed along the outer periphery, wherein a plurality of insert openings are alternately formed among the guide teeth, wherein the cylindrical rotor is rotatably introduced through the cylindrical opening of the medicine case and serves to temporarily maintain the tablets within the medicine case, and wherein a waved guide having a vertex is formed on the upper surface of the cylindrical rotor;

c) a male gear disposed below the medicine case and rotatably engaged to the cylindrical rotor so that the cylindrical rotor can be rotated in correspondence to the male gear, whereby the tablets maintained in the medicine case are serially loaded in each of the insert openings and the measure quantity of the tablets are controllably dropped into a corresponding one of the release holes; and d) a vertically raised protrusion formed on the central surface portion of said upper surface of said rotor so as to smoothly agitate the tablets received in the medicine case and prevent said tablets from tangling together with said waved guide while allowing the tablets to be evenly loaded into said each insert opening when the rotor is rotated by the male gear.

2. The automatic tablet dispenser of claim 1 further comprising a motor disposed below the male gear and connected to the male gear so that the rotation of the cylindrical rotor can be powered through the male gear by the motor.

3. The automatic tablet dispenser of claim 2 further comprising a cover detachably covering the medicine case, wherein the cover has a compartment with a porous covering, wherein the compartment is attached beneath the cover and stores therein tablet protecting agents.

4. The automatic tablet dispenser of claim 3 further comprising at least one auxiliary case wall flexibly provided between the medicine case and the cover for thereby increasing a tablet capacity of the medicine case.

5. The automatic tablet dispenser of claim 4, wherein the vertically raised protrusion is cylindrical.

* * * * *